United States Patent [19]

Chappell et al.

[11] 4,087,207

[45] May 2, 1978

[54] METHOD AND APPARATUS FOR GAS INDUCED PRODUCTION OF LIQUID FROM WELLS

[76] Inventors: Walter L. Chappell; John T. Cleveland, both of 2836 Delafield St., Houston, Tex. 77023; John D. Watts, P.O. Box 79466, Houston, Tex. 77079

[21] Appl. No.: 662,503

[22] Filed: Mar. 1, 1976

[51] Int. Cl.[2] ..... F04F 1/20

[52] U.S. Cl. ..... 417/54; 137/504; 166/320; 166/321; 417/110; 417/117

[58] Field of Search ..... 417/108, 109, 110, 117, 417/54; 166/53, 224 A, 319-329; 137/498, 504

[56] References Cited

U.S. PATENT DOCUMENTS

| | | | |
|---|---|---|---|
| 2,253,396 | 8/1941 | Peake | 417/117 |
| 3,366,074 | 1/1968 | Shirley | 417/117 |
| 3,433,174 | 3/1969 | Chenoweth | 417/117 |
| 3,543,848 | 4/1969 | Garrett | 417/117 X |
| 3,757,816 | 9/1973 | Price | 166/224 A |
| 3,968,839 | 7/1976 | Swihart, Sr. | 166/53 X |

*Primary Examiner*—Carlton R. Croyle
*Assistant Examiner*—Leonard E. Smith

[57] ABSTRACT

A method of achieving gas induced production of liquid from wells wherein the wells have a production tubing string extending to a production formation wherein such wells may have insufficient gas production for achieving continuous production of liquids from such wells. The method includes establishing a liquid accumulation chamber being located downstream of a gas accumulation chamber and being in communication with the tubing string, while the gas accumulation chamber is in communication with the production formation. Liquid from the production formation is produced by maintaining a condition of predetermined low flow of gas and liquid produced from the production formation. The method includes accumulating a predetermined quantity of liquid within the liquid accumulation chamber during the predetermined low flow condition, while simultaneously accumulating a quantity of gas within the gas accumulation chamber. Upon accumulation of the predetermined volume of liquid within the liquid accumulation chamber, a quantity of gas from the gas accumulation chamber is suddenly released into the liquid accumulation chamber, transporting a portion of the accumulated liquid from the liquid accumulation chamber upwardly through the tubing string for production thereof. Suitable apparatus for achieving the method of the present invention may include a flow control mechanism connected to the tubing string and cooperating with the tubing string to define the liquid accumulation chamber and the gas accumulation chamber. Movable orifice restrictor means may be connected to the flow control means and may be automatically movable between a first position establishing the condition of low flow and a second position establishing a condition of increased flow. The movable orifice restrictor means may be movable to the first position thereof by the mass flow rate of the flowing production fluid medium and may be movable to the second position thereof by urging means in response to accumulation of the predetermined quantity of liquid within the liquid accumulation chamber.

1 Claim, 3 Drawing Figures

FIG.1
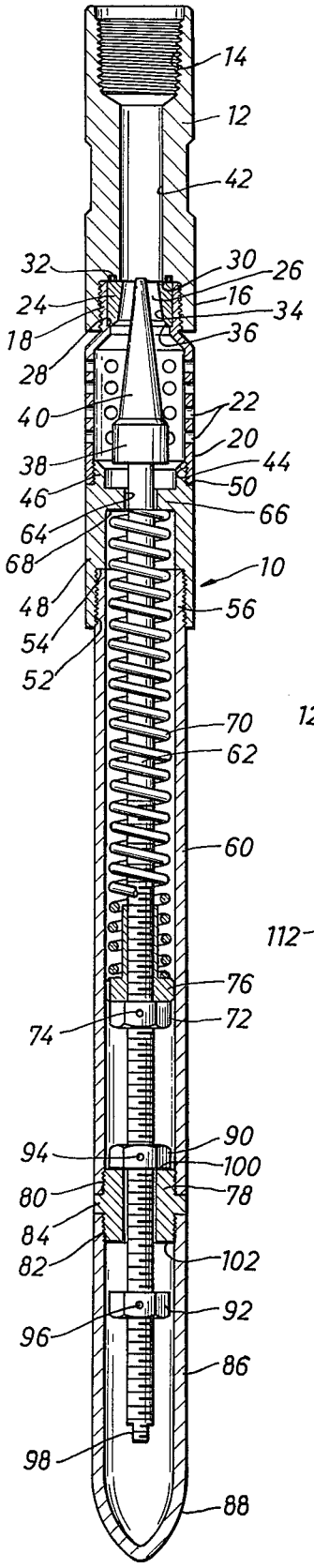
FIG. 2
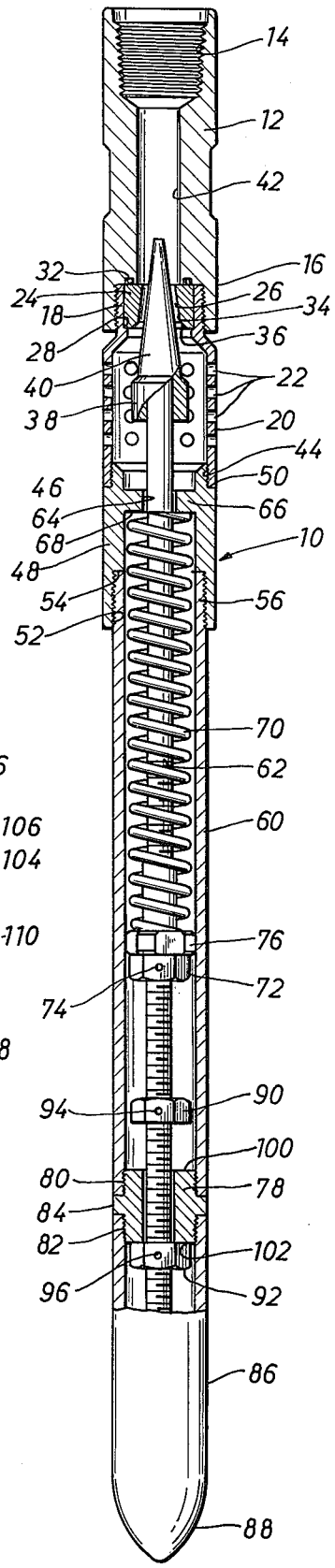
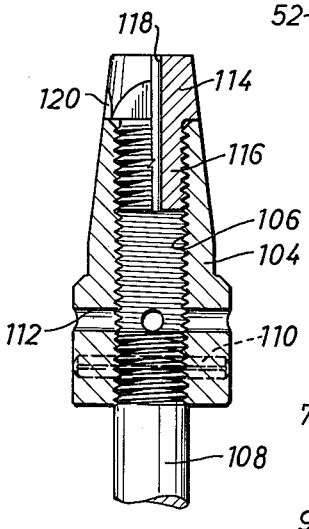
FIG. 3

METHOD AND APPARATUS FOR GAS INDUCED PRODUCTION OF LIQUID FROM WELLS

FIELD OF THE INVENTION

This invention relates generally to the production of liquid and/or gas from wells wherein gas is utilized for the purpose of inducing upward flow of liquid from a production formation through a tubing string for production of the liquid and/or gas. More specifically, the present invention is directed to a method and apparatus for production of liquid and/or gas from a production formation wherein gas flowing from the formation is insufficient to cause continuous production of liquid from the formation through the tubing string. The invention generally concerns accumulation of both liquid and gas within the well until a predetermined quantity of liquid has been accumulated. Thereafter, a large quantity of the accumulated gas is automatically introduced into a liquid storage chamber to provide the gas induced force necessary to transport at least a portion of the accumulated liquid upwardly through the tubing string for production thereof.

BACKGROUND OF THE INVENTION

Where there is sufficient migrating gas in a production formation to produce liquid from that formation, wells generally incorporate at least one production tubing string connected to suitable well head structure and extending to one or more production formations. A flow bean is typically connected to the well head and establishes a production orifice through which gas and liquid flow from the formation. As the gas flows upwardly through the tubing string, a quantity of liquid is transported with it and is produced at the well head. Liquid will be produced along with the gas, therefore, as long as a relatively high quantity of gas is flowing from the formation into the tubing string.

In the event gas flow within a well is insufficient to cause continuous production of the liquid accumulating within the tubing string, the liquid may in some wells accumulate until the hydrostatic head of the accumulated liquid equals or exceeds the bottom hole pressure of the well, and the well will then become dormant. When this condition develops, the well has been "killed" by accumulation of the liquid produced from the formation. When a well has become killed by accumulated liquid, it will be shut-in by closing the surface valve of the tubing string. Gas from the formation will bubble through the liquid column within the well and will build a head of pressure above the liquid column, serving to drive the liquid column back into the formation, thereby reducing the hydrostatic head of the liquid. As soon as a sufficient volume of liquid has been forced back into the formation by the accumulation of gas above the liquid column, an operation which may take several hours or several days time, the well may be again placed in production service simply by opening the tubing valve. Accumulated liquid within the tubing string downstream of the flow bean will be produced along with the gas flowing from the well until such time as the gas decreases and allows the liquid column to again build sufficiently to overcome the bottom hole pressure and kill the well. The well then must be shut-in by closing the tubing valve and allowing the accumulated gas to again force a substantial volume of the accumulated liquid back into the production formation. To produce a well having insufficient gas flow for continuous production, it is required that the well be periodically be shut-in in the manner described above. This is a very expensive and time consuming procedure because it requires operating personnel to visit the well site periodically to open and close the tubing valve in accordance with the condition of the well. The cost of producing such wells frequently exceeds the commercial production that is obtainable from the wells, and in such case the wells are permanently shut-in. One of the more important problems associated with conventional methods of producing wells of this type results in severe loss of production, and therefore loss of profits of the production operation.

It is desirable to provide means for automatically controlling production of such wells responsive to the condition of the well. It is also desirable to provide means for achieving production from wells, whether the gas for causing production flows from the formation along with the liquid being produced or is injected either at or remote from the well being produced. It is therefore a primary feature of the present invention to provide a novel well production control mechanism that is connected to the tubing string of a well and is responsive to well conditions for achieving production flow of gas and liquid from the well.

It is also a feature of the present invention to provide a novel well production aid and control mechanism that functions to define a liquid accumulation chamber and a gas accumulation chamber within the well and which mechanism is responsive to well conditions for periodic injection of accumulated gas from the gas accumulation chamber into the liquid accumulation chamber for production of accumulated liquid therein.

It is another important feature of the present invention to provide a novel well production control mechanism that functions as a choke device to provide for substantially continuous flow of gas and liquid from the production formation into a liquid accumulation chamber that is in communication with the tubing string of the well.

It is also an important feature of the present invention to provide a novel method of producing liquid from wells, which method includes simultaneous accumulation of liquid and gas within respective liquid and gas accumulation chambers, and, upon accumulation of a predetermined volume of liquid within the liquid accumulation chamber, automatically causes injection of gas from the gas accumulation chamber into the liquid accumulation chamber to cause production of at least part of the liquid that has accumulated within the liquid accumulation chamber.

It is an even further feature of the present invention to provide a novel method of producing liquid from wells having insufficient gas pressure for continuous production thereof without a production aid mechanism, which method results in conservation of gas in the production formation, thereby allowing a greater volume of liquid to be produced than would ordinarily be attainable through conventional production methods.

It is also an important feature of the present invention to provide a novel method of achieving production from a production formation having insufficient pressure for production thereof, wherein such method is accomplished by continuous flow of gas with such flow being varied intermittently in accordance with the condition of the production formation, as desired.

Other and further features, advantages and objects of the present invention will become apparent to one skilled in the art upon consideration of the present disclosure. The form of the invention which will now be described in detail illustrates the general principles of the invention, but it is to be understood that this detailed description is not to be taken as limiting the scope of the present invention.

SUMMARY OF THE INVENTION

The present invention is directed specifically to a method of producing liquid from wells wherein the wells communicate with a production formation by means of one or more tubing strings extending from a well head to the production formation. The method includes the development of a gas accumulation chamber within the well which is in communication with the production formation. A liquid accumulation chamber is defined within the well immediately downstream of the gas accumulation chamber and receives both liquid and gas flowing from the gas accumulation chamber across an orifice of a predetermined size. Flow of both liquid and gas from the production formation to the gas accumulation chamber and into the liquid accumulation chamber is allowed to occur substantially continuously until such time as a predetermined quantity of liquid has accumulated within the liquid accumulation chamber. A large quantity of gas having accumulated within the gas accumulation chamber will be allowed to flow suddenly into the liquid accumulation chamber, thereby providing sufficient motive force for production of at least a substantial quantity of the accumulated liquid by forcing it upwardly through the tubing string for production at the well head. The liquid will be produced as a slug at the well head utilizing only sufficient gas to achieve production thereof. Responsive to production of the slug of liquid, the well production mechanism will revert to its condition of gas and liquid accumulation until such time as another predetermined volume of liquid has accumulated within the liquid accumulation chamber. The method according to the present invention contemplates injection of a substantial quantity of gas from the gas accumulation chamber into the liquid accumulation chamber responsive to the development of a predetermined hydrostatic head within the liquid accumulation chamber.

Apparatus for producing liquid from wells in accordance with the foregoing method may conveniently take the form of a choke mechanism having a low flow rate and a high flow rate. The choke mechanism will be typically set at its low flow rate during accumulation of both liquid and gas. Upon accumulation of a predetermined volume of liquid within the liquid accumulation chamber, the choke mechanism will automatically move from its low flow rate to its high flow rate, thereby allowing sudden injection of an additional quantity of gas from the gas accumulation chamber into the liquid accumulation chamber to provide sufficient motive force for driving a slug of liquid upwardly through the tubing string for production thereof. The choke mechanism may be moved automatically to its condition of low flow rate by the mass flow rate of the gas flowing past a choke controller and may be moved to its condition of increased flow by compression spring when the hydrostatic head of the liquid accumulated within the liquid accumulation chamber reaches a predetermined value in correlation with the differential pressure across the device.

BRIEF DESCRIPTION OF THE DRAWINGS

So that the manner in which the above recited features, advantages and objects of the present invention, as well as others which will become apparent, are attained and can be understood in detail, more particular description of the invention briefly summarized above may be had by reference to the embodiment thereof which is illustrated in the appended drawings, which drawings form a part of this specification.

It is to be noted, however, that the appended drawings illustrate only a typical embodiment of the invention and are therefore not to be considered limiting of its scope, for the invention may admit to other equally effective embodiments.

In the drawings:

FIG. 1 is a sectional view in elevation illustrating a well flow control mechanism constructed in accordance with the present invention, showing the flow controller thereof being positioned in the open condition thereof, allowing maximum flow of gas across the flow restriction device.

FIG. 2 is a sectional view in elevation showing the flow control mechanism of FIG. 1 and illustrating the flow controller being positioned in the restricted position thereof, allowing flow across the orifice to occur at a low flow rate.

FIG. 3 is a fragmentary sectional view of the flow controller portion of a well production aid mechanism representing a modified embodiment of the present invention which operates in accordance with the method of this invention.

DESCRIPTION OF PREFERRED EMBODIMENT

Referring now to the drawings and first to FIGS. 1 and 2, a preferred embodiment of the present invention is shown generally at 10 which includes an adapter sub 12 having the upper extremity thereof internally threaded as shown at 14 for connection of the flow control mechanism to any suitable support structure. The support structure may simply be the externally threaded lower extremity of the tubing string in the event it is desirable to connect the flow control mechanism directly to the tubing string. In the alternative, the internal threads 14 may conveniently receive the lower externally threaded extremity of a suitable wireline or pump-down tool that may be utilized in conventional manner for achieving placement of the flow control mechanism at the appropriate level within the well.

The adapter sub 12 may be formed to define an internally threaded lower extremity 16 within which may be received an externally threaded portion 18 of a perforated section 20 having a plurality of perforations 22 formed therein, through which communication is established with the production formation, allowing production fluid to flow through the perforations into the well production control mechanism.

It will be desirable to provide the well production control mechanism with means for controlling the flow of fluid medium, i.e., gas and liquid, and for this purpose a flow restrictor may be provided as shown at 24, defining a restricted orifice 26 through which the production fluid flows. The flow restrictor 24 may be received in closely fitting relation within the upper extremity of the perforated section 20 and may be encapsulated between retaining shoulders 28 and 30 defined, respectively, on the perforated section 20 and the adapter sub 12. A sealing element 32, which may conveniently take the form of an O-ring contained within an annular O-ring groove, may be utilized to establish a seal between the adapter sub 12 and the flow restrictor 24. The flow restrictor may also be formed to define internal frusto-conical surfaces 34 and 36 that cooperate with a flow controller 38 in the manner described hereinbelow for the purpose of controlling the rate of flow of the production fluid medium through the well production control mechanism. The flow controller 38 includes an elongate tapered or frusto-conical portion 40 having a portion thereof which is positioned within the internally tapered portion 34 of the flow restrictor and which cooperates with the flow restrictor to define the effective dimension of the orifice 26. For the reason that the area of greatest flow induced wear of the well production control mechanism will occur at the tapered surface 40 of the flow controller 38 and the internal surface 34 of the flow restrictor 24, these parts may be formed of very hard wear-resistant material such as sintered tungsten carbide, for example, for longer life.

The adapter sub 12 is formed to define an internal bore 42 through which produced fluid flows from the orifice 26 into the tubing string to which the well production control mechanism is connected. The perforated section 20 of the well production control mechanism 10 may be formed to define internal threads 44 at the lower extremity thereof that receive an externally threaded portion 46 of a connector section 48. The connector section is formed to define an annular shoulder 50 against which the lower extremity of the perforated section abuts, thereby establishing a rigidly supported relationship between the perforated section 20 and the connector section 48 of the well production control mechanism. The lower extremity of the connector section 48 may be formed to define internal threads 52 and an annular internal shoulder 54 that function to provide threaded abutting support with the externally threaded upper extremity 56 of a spring housing section 60 of the well production control mechanism.

It will be desirable to provide means for imparting controlling movement to the flow controller element 38 to achieve appropriate variation in the effective size of the orifice 26 and thereby control the rate of flow from the production formation through the well production control mechanism. One suitable means for imparting controlling movement to the flow controller 38 may conveniently take the form of an actuator stem 62 that is connected at the upper extremity thereof to the flow controller 38 in any suitable manner. The actuator stem 62 extends downwardly from the flow controller through a guide opening 64 defined by an internal intermediate flange 66 of the connector section 48. The internal flange 66 also defines a thrust surface 68 of annular configuration against which abuts the upper extremity of a compression spring 70 that serves to impart a motive force to the flow controller 38 to urge the flow controller toward the more open position thereof, as illustrated in FIG. 1. To enable the compression spring 70 to be retained in compressed position, the actuator stem 62 may be provided with external threads, and a spring retainer nut 72 may be received by the threaded portion of the actuator stem and may be secured in place by means of an Allen screw 74 or some other suitable means for locking the spring retainer nut in position on the actuator stem. A spring guide element 76 may be positioned about the actuator stem 62 and may be urged into abutting relation with the retainer nut 72 by means of the lower extremity of the compression spring.

It will also be desirable to provide means for positioning the flow controller 38 in a high flow position or a low flow position relative to the flow resistor 24, depending upon the particular condition of the well to be controlled. In accordance with the present invention, this may be accomplished by providing a stop element 78 having externally threaded upper and lower portions 80 and 82 separated by an intermediate annular abutment flange 84. The upper threaded extremity of the stop element may be received by internal threads defined at the lower extremity of the spring housing section, thereby enabling the stop element to be positively retained in stabilized relationship with the spring housing section. For the purpose of closing the lower extremity of the well production control mechanism, a lower housing section 86 may be provided having an internally threaded upper portion that is received by the lower threaded extremity 82 of the stop element 78. A bottom plug element 88 may be threadedly received at the lower extremity of the lower housing section 86 and may complete the housing enclosure.

Upper and lower positioning elements 90 and 92 may be received by the threaded portion of the actuator stem 62 and may be secured in position relative to the stem by means of lock elements 94 and 96 respectively that may conveniently take the form of Allen screws, for example. The positioning elements may conveniently take the form of conventional internally threaded nuts that may be positioned relative to the actuator stem simply by rotating the nuts relative to the stem. The actuator stem may also be provided with a non-circular lower portion 98 that is of a suitable configuration to receive a conventional wrench so that the actuator stem may be rotated by means of a wrench when stabilizing the nut elements 72, 90 and 92 is accomplished by means of another wrench.

The stop element 78 is also formed to define upper and lower annular stop surfaces 100 and 102 respectively that are engaged, respectively, by the upper and lower positioning elements or nuts 90 and 92, depending upon the particular condition of the well production control mechanism. The upper positioning element 90, when in engagement with the upper stop surface 100, as shown in FIG. 1, is effective to limit the downward movement of the flow controller 38, thereby cooperating with the flow restrictor 24 to define an orifice of predetermined effective size, depending upon the production condition of the well. Since a given well of the type described above has relatively close limits within which it can function for efficient production of the fluid medium of the formation, the flow condition of the well must be preset between precise flow rates that shall be referred to as the high flow rate and the low flow rate. The positioning elements 90 and 92 will be adjusted as necessary to preset the well production control mechanism for operation thereof between the high and low flow rates. For example, if a well is capable of sustaining a certain oil, gas and water average flow rate when unloaded, the low flow rate must be less than the average, while gas accumulates below the flow restrictor of the well production control mechanism and liquid accumulates above the flow restrictor. The high flow rate allowed by the well production control mechanism must exceed the average flow rate to produce the minimum lift velocity up the tubing after the mechanism of the well production control system moves the flow controller to its more open position, allowing the gas to blast the liquid to the surface. It is important that the well production mechanism prevent accumulation of more liquid above the flow restrictor than can be lifted by injection of a stored accumulation of gas, because the well will simply be killed by the hydrostatic head of the liquid in the same manner as if the flow control mechanism were not present. Also, no more gas should be used per cycle of operation of the well production control mechanism than is necessary to lift the liquid, thereby prolonging the flowing life of the well by conserving the gas pressure of the formation. In the alternative, when injected gas is employed, either injected into the formation or injected into the well bore, it is also desirable to conserve the power and lifting potential of the injected gas through utilization of a minimum quantity of gas for each production cycle of the well production control mechanism. It is also important that the well head pressure be sufficiently great to cause flow of the produced liquid into the flow line of the well head assembly, but not sufficiently great to prevent the flow mechanism from achieving automatic production of the well. The high and low flow rates and their respective durations must not combine to exceed the intended average flow rate of the well, which may otherwise cause damage to the producing formation or kill the well. In the alternative, however, a combined flow rate of the high and low flow rates of the well production control mechanism, if excessively low, could render the production of the well economically unjustifiable. These various parameters must be considered when presetting the high and low flow rates of the well production control mechanism.

It may be desirable to provide a production aid mechanism for producing liquid and gas from wells, wherein the production aid mechanism incorporates separate high and low flow orifices. Such is conveniently accomplished by providing a well production aid mechanism incorporating a flow controller such as depicted in FIG. 3. The flow controller of FIG. 3 includes a body portion 104 having an internally threaded bore 106 formed therein. The upper externally threaded extremity of an actuating stem 108 may be received within the internally threaded bore and the connection between the flow controller and the actuating stem may be secured by a roll pin 110 received within appropriately aligned bores formed in the flow controller and actuating stem.

A plurality of bores or passages may be formed in the flow controller body and may serve to communicate pressurized production fluid from the gas accumulation chamber portion of the production aid mechanism into the internally threaded bore 106. The upper or downstream extremity of the internally threaded bore 106 may receive the externally threaded portion 116 of a flow bean element 114 which is formed to define a restricted choke passage 118. The flow bean establishes the low flow condition of the production aid mechanism when the tapered external surface of the flow controller element is seated against the internally tapered surface of the flow restrictor, such as shown at 34 in FIGS. 1 and 2. In this case it will not be necessary to provide a stop for limiting the upward travel of the flow controller because the seated relationship limits upward travel of the flow controller. Of course, the production aid mechanism of this invention may take many other forms without departing from the spirit or scope of the present invention.

OPERATION

Assuming that the positioning elements 90 and 92 of the well production control mechanism have been preset relative to the actuating stem, and the respective locking elements 94 and 96 have been secured, the two positions of the flow controller element 38 will have been established in accordance with the production capabilities of the well. Likewise, the spring retainer nut 72 will have been properly positioned relative to the actuator stem 62 and locked in place by means of locking element 74, thereby establishing proper compression of the compression spring 70 relative to the bottom hole pressure of the well. Also, other parameters are considered in connection with the establishment of spring compression, these parameters including the depth of the well, the quantity of liquid accumulation that is desired for efficient production, the specific gravity of the liquid to be produced, etc. The adapter sub 12 may then be attached to the lower extremity of the tubing string, and the well production control mechanism may be run into the well and emplaced along with the tubing string. In the alternative, the adapter sub may be connected to a suitable wire line tool, pump-down tool, etc., and may be run into the well and emplaced by such tools or by any other suitable means of emplacement. Following emplacement, the well may be placed into production simply by opening the flow line valve at the well head, thereby allowing gas and liquid to flow from the tubing string and be produced through the flow line. If little or no liquid has accumulated within the tubing string downstream of the flow restrictor 24, very little hydrostatic head will exist, and the differential pressure across the flow restrictor will be at or near its maximum. With the flow controller 38 being maintained in the more open or high flow position thereof, as shown in FIG. 1, the orifice 26 resulting from positioning of the tapered portion 40 of the flow controller relative to the tapered opening 34 of the flow restrictor will be at its maximum effective size. The compression spring 70 of course urges the actuator stem downwardly, and thereby also urges the flow controller 38 toward its more open position. In view of the fact that the presetting of the compression spring and positioning of the flow restrictor orifice opening has been determined responsive to well conditions by presetting the condition of the positioning elements 90 and 92, as well as spring retainer element 72, the closing force developed on the flow controller 38 by the mass flow rate of the flowing production fluid will overcome the spring compression force, thereby causing movement of the flow controller 38 to the more closed or FIG. 2 position thereof, thereby restricting the effective size of the orifice 26 and thereby reducing the rate of flow across the orifice.

As explained above, the low flow position of the flow controller 38 will be preset by establishing proper positioning of positioning element 92 relative to the actuator stem 62. As the flow controller 38 and the actuator stem are forced upwardly by the mass flow rate of the production fluid, the positioning element 92 will contact stop surface 102, thereby limiting further upward movement of the flow controller and thereby also preventing the flow controller from completely shutting off the flow. This low flow position is established in accordance with the production capabilities of the well so as to establish a flow rate that is less than the average flow rate of the oil, gas and water produced by the well when the well is in the unloaded condition thereof. Under this particular flow condition, the gas flowing across the orifice 26, through the bore 42 of the adapter sub, and into the tubing string will flow at an insufficient rate for lifting the liquid that is produced from the production formation. The flowing gas will simply bubble through the liquid and will flow upward through the tubing string to the flow line. The gas flowing across the restricted orifice 26, however, will be at sufficient velocity because of the orifice restriction to transport liquid through the orifice and into the adapter sub and tubing string. As long as the well production control mechanism is in the low flow condition thereof, liquid will continuously accumulate within the tubing string immediately downstream of the flow restrictor. This column of accumulated liquid will of course develop a hydrostatic head, and the hydrostatic head of the continuously increasing or building column of liquid will result in continuous decrease in the differential pressure across the orifice of the flow restrictor. The force acting upon the flow controller 38 which is responsive to this differential pressure across the orifice will be continuously reducing as the hydrostatic head of the liquid is increasing.

For the reason that the low flow position of the flow controller reduces the flow rate across the orifice 26, gas will be produced from the production formation into the well bore in the vicinity of the production formation at a greater rate than is being exhausted across the restricted orifice 26. This condition causes a quantity of gas to accumulate upstream of the flow restrictor 24, and the accumulation of gas takes place simultaneously with accumulation of liquid downstream of the flow restrictor. The flow restrictor therefore serves as a partition, dividing the well and establishing a liquid accumulation chamber downstream of the flow restrictor and a gas accumulation chamber upstream of the flow restrictor. The gas accumulated upstream of the flow restrictor may be effectively utilized for production of the accumulated liquid.

As indicated above, as the hydrostatic head of liquid builds immediately downstream of the flow restrictor, with the well production control mechanism in the low flow condition thereof, the resulting force developed by differential pressure across the restricted orifice 26 becomes offset by the increasing pressure of the increasing hydrostatic head. At a particular time, depending upon the degree of compression of the spring 70, the preset urging force of the compression spring will overcome the differential pressure force that urges the flow controller toward the more closed position thereof. When the spring force overcomes the differential pressure force, the flow controller element will be suddenly moved by the compression spring to the full open position thereof, as shown in FIG. 1. The position element 90 will engage the upper stop surface 100 of the stop element, thereby limiting movement of the flow controller and establishing the preset condition of the flow controller relative to the tapered passage 34 of the flow restrictor. When the flow controller 38 has moved suddenly to the FIG. 1 position thereof, at least a substantial portion of the accumulated gas upstream of the flow restrictor is allowed to suddenly be vented across the orifice of the flow restrictor and into the liquid accumulation chamber by virtue of the suddenly increased size of the orifice. This blast of gas will be sufficient to lift the column of liquid that has accumulated within the accumulation chamber and transport it as a slug upwardly through the tubing string to the well head facility where it is produced through the flow line of the well head.

During lifting of the column and after the column of liquid has been so lifted, the oil, water and gas from the production formation will continue to flow through the well production aid mechanism. The urging force on the compression spring acting upon the flow controller, however, will be overcome by the mass flow rate of the flowing production medium, and the force developed by the mass flow rate will shift the flow controller 38 against the compression of the spring 70, again to the low flow position thereof as shown in FIG. 2. The production cycle of the well production control mechanism will therefore again be automatically initiated. A single production cycle of the well production control mechanism includes shifting of the flow controller 38 to the low flow position thereof against the compression of the spring 70, thereby causing further flow to be reduced and allowing accumulation of liquid downstream of the flow restrictor and gas upstream of the flow restrictor. When the hydrostatic head of the liquid accumulated downstream of the flow restrictor reaches a predetermined value, the force overcoming the compression of the spring 70 will be depleted, and the spring will therefore automatically shift the actuator stem and flow controller downwardly to the high flow position thereof, allowing accumulated gas upstream of the flow restrictor to be injected as a lifting blast into the liquid accumulation chamber immediately downstream of the flow restrictor. This blast of accumulated gas lifts the column of liquid and produces it and begins to be depleted as it flows through the flow line of the well head. As this occurs, the mass flow rate of the fluid flowing across the orifice develops a force acting upon the flow controller 38 that is sufficient to overcome the compression of the spring and again move the flow controller back to the low flow condition thereof. The well production control mechanism will therefore automatically cycle responsive to well conditions and will automatically cause production of all the liquid that can be produced by the well at the maximum effective rate of production. The well production control mechanism, however, may allow production of only sufficient gas to achieve lifting and production of the liquid or more if more gas production is desired. The mechanism will function efficiently, regardless of the origin of the gas, i.e., whether it be produced naturally from the formation, injected into the formation at a remote point and produced through the formation, or injected directly into the well to achieve gas lift production. In each case, the well production control mechanism functions in the same manner to cause effective lifting and production of liquid through utilization of a minimum amount of gas. This of course allows low cost production from any given production formation and effectively conserves the gas that is utilized for production of liquid. A production formation will therefore be allowed to produce longer under gas pressure than would ordinarily be possible through utilization of conventional gas induced production.

Regardless of whether the apparatus is wire line retrievable or whether it is attached to the tubing string and is retrievable along with the tubing, it is designed to be preset in accordance with the conditions of the well before it is emplaced in the well. The well production control mechanism, as shown in the drawings and described herein, is automatically actuatable in accordance with the production conditions of the well and effective to produce liquid at the maximum effective rate allowed by the production formation. It is within the scope of the present invention, however, to provide a mechanism that may be remotely actuatable, either through control of well pressures or by actually controlling positioning of the flow controller responsive to a timing sequence or responsive to other events that may be utilized for purposes of control. A single two-position flow control orifice may be utilized, as defined hereinabove, or, in the alternative, multiple orifice apparatus may also be utilized for accomplishing production of wells in accordance with the teachings of the present invention. The apparatus may take any suitable form that is capable of providing flow of production medium from the well under conditions of predetermined high and low flow. For example, a device may be employed having an orifice that is formed for establishment of the low flow condition of the well, and a separate orifice may be opened and closed in accordance with well production conditions for achieving the high flow conditions of the mechanism. The present invention, therefore, contemplates apparatus other than shown and described herein for the purpose of achieving production of wells in accordance with the method established herein.

In view of the foregoing, it is apparent that the present invention is therefore well adapted to attain all of the features and advantages hereinabove set forth, together with other advantages which will become obvious and inherent from a description of the apparatus itself. It will be understood that certain combinations and sub-combinations are of utility and may be employed without reference to other features and sub-combinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A method of continuously producing gas and liquid from a well established within the well condition limitations comprising the steps of:

(a) positioning a two position mass flow controller in the production tubing string of said well at an optimum level above the producing formation to make most efficient use of the stored energy in the pressurized gas and liquid;

(b) forming a gas accumulation chamber upstream of the said controller;

(c) forming a liquid accumulation chamber in the tubing string above the controller;

(d) forming a flow restrictive opening in the controller passing all fluid that flows from said gas accumulation to said liquid accumulation through the opening;

(e) positioning a flow restrictor adjacent said opening;

(f) positioning means for continually urging said flow restrictor to said high flow position;

(g) positioning means for controlling movement of the flow restrictor relative to the opening;

(h) positioning and enabling the means for conrolling the flow restrictor to be directly related to the high mass flow rate and low mass flow rate of fluid flowing through the opening into the tubing string above the regulator such that the resulting daily mass flow rate at both the high flow condition and the low flow condition approximates the average predetermined optimum flow capability of the well;

(i) positioning the means for urging the flow restrictor to the high flow position and presetting same to shift to the low flow position when the high mass flow rate is exceeded;

(j) positioning the means for urging the flow restrictor to the high flow position and presetting the means for establishing the high flow rate and the low flow rate of fluid into the tubing string within the physical conditions and production rate of the well;

(k) accumulating sufficient liquid in the liquid accumulation chamber to enable the hydrostatic head formed by the accumulated liquid in cooperation with as pressure above it and the restrictor means to overcome the well pressure below the low restrictor to cause said flow restrictor to move relative to said opening from the low mass flow rate position to the high mass flow rate position thereby allowing a relatively large volume of gas to move upwardly into the liquid accumulation chamber to thereby lift the accumulated liquid at a sufficient velocity to produce said liquid through the tubing to the surface of the well and thence to the flow line;

(l) exceeding the high mass flow rate wherein said means for urging said flow restrictor to said high flow position is overcome, thereby shifting said restrictor to the low flow position to enable liquid to accumulate once more in the liquid accumulation chamber in the tubing string.

* * * * *